US005090364A

United States Patent [19]

McCarroll et al.

[11] Patent Number: 5,090,364

[45] Date of Patent: Feb. 25, 1992

[54] TWO-STEP VALVE OPERATING MECHANISM

[75] Inventors: Michael E. McCarroll, Rochester; Mark J. Spath, Spencerport; Mark A. Shost, Henrietta; Timothy W. Kunz, Rochester; Guy E. Giannone, Bergen; John Castellana, Fairport, all of N.Y.

[73] Assignee: General Motors Corporation, Detroit, Mich.

[21] Appl. No.: 628,694

[22] Filed: Dec. 14, 1990

[51] Int. Cl.[5] ..... F01L 1/34; F01L 1/14

[52] U.S. Cl. ..... 123/90.16; 123/90.48

[58] Field of Search ..... 123/90.15, 90.16, 90.2, 123/90.22, 90.27, 90.48

[56] References Cited

U.S. PATENT DOCUMENTS

| | | | |
|---|---|---|---|
| 4,164,917 | 8/1979 | Glasson | 123/90.16 |
| 4,637,357 | 1/1987 | Ohmi | 123/90.48 |
| 4,699,094 | 10/1987 | Stegeman | 123/90.46 |
| 4,745,888 | 5/1988 | Kapp | 123/90.33 |
| 4,793,296 | 12/1988 | Inoue et al. | 123/90.16 |
| 4,887,561 | 12/1989 | Kishi | 123/90.16 |
| 4,905,639 | 3/1990 | Konno | 123/90.16 |
| 4,909,195 | 3/1990 | Hasebe et al. | 123/90.16 |
| 4,926,804 | 5/1990 | Fukuo | 123/90.16 |
| 5,036,807 | 8/1991 | Kaneko | 123/90.16 |
| 5,042,436 | 8/1991 | Yamamoto et al. | 123/90.16 |
| 5,042,437 | 8/1991 | Sakuragi et al. | 123/90.16 |

FOREIGN PATENT DOCUMENTS 3904681 8/1990 Fed. Rep. of Germany .

*Primary Examiner*—E. Rollins Cross
*Assistant Examiner*—Weilun Lo
*Attorney, Agent, or Firm*—Robert J. Outland

[57] ABSTRACT

A camshaft has, for each valve lifter, a high lift cam between two low lift cams, the high lift cam fitting within the envelope of the low lift cams. The lifter comprises an outer tappet elongated in the direction of the camshaft and slidably mounted in an elongated bore in a cam carrier. The outer tappet is contacted by both low lift cams and operates two valves simultaneously. An elongated bore extending transverse of the outer tappet carries an elongated inner tappet which is contacted by the high lift cam. A hydraulically actuated locking mechanism couples the tappets for movement together for high lift operation and unlocks for low lift operation to allow the inner tappet to idle in the outer tappet.

17 Claims, 5 Drawing Sheets

FIG 1
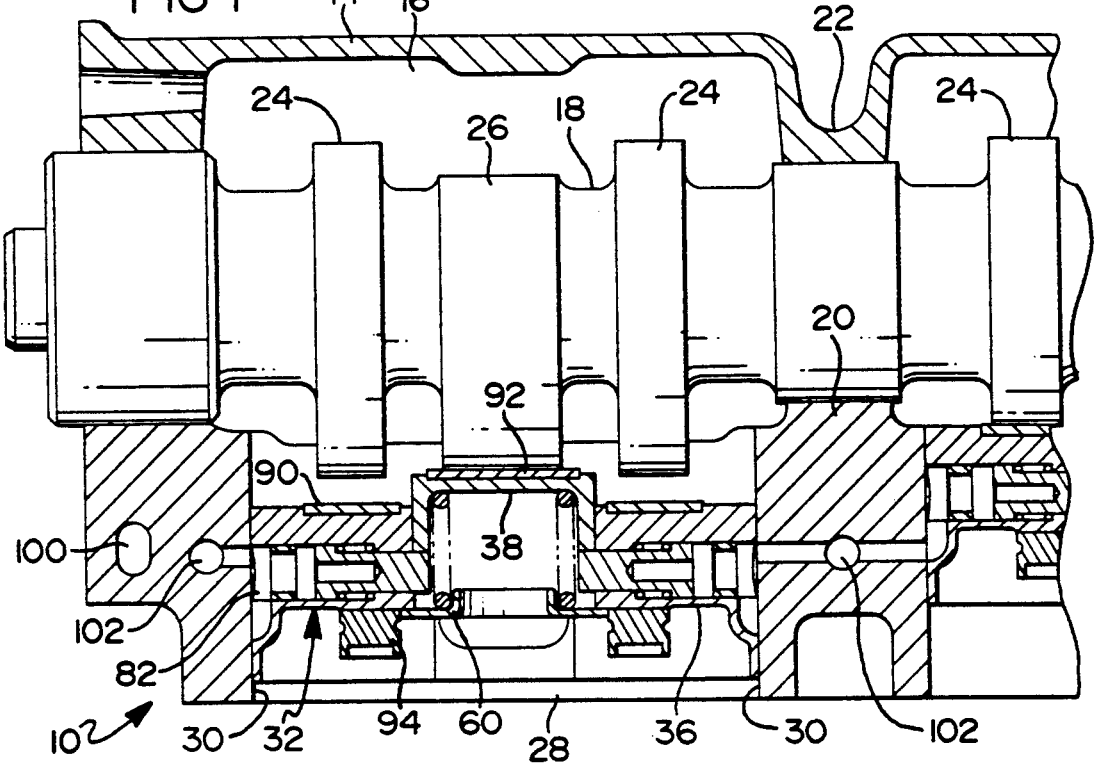
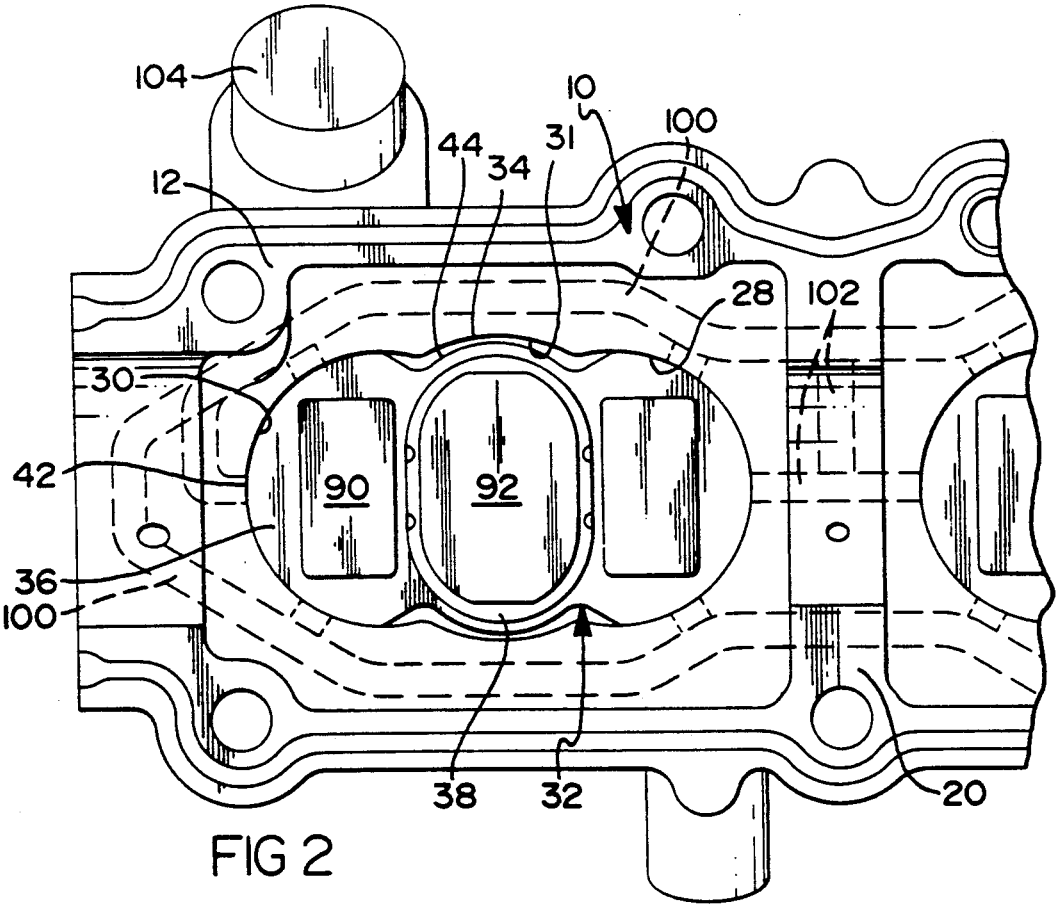
FIG 2

FIG 12
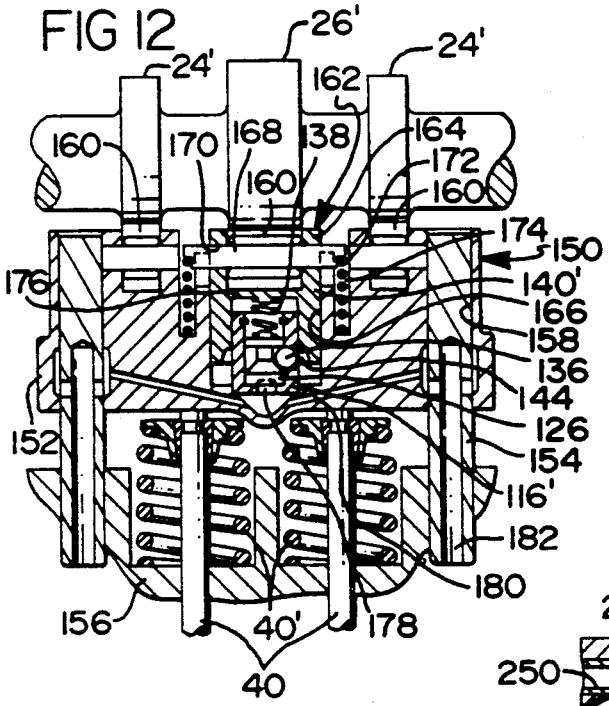
FIG 13
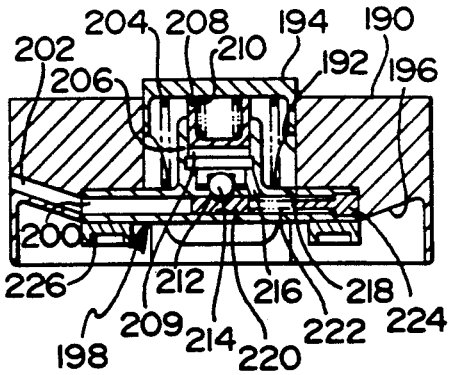
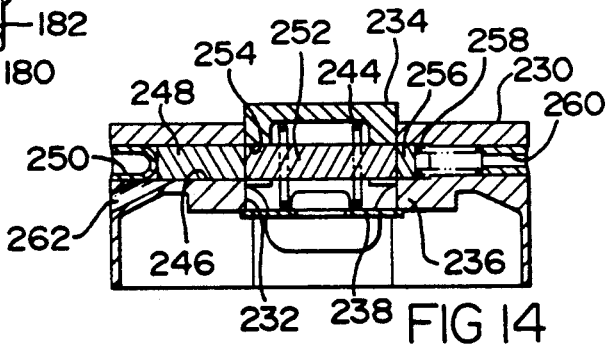
FIG 14
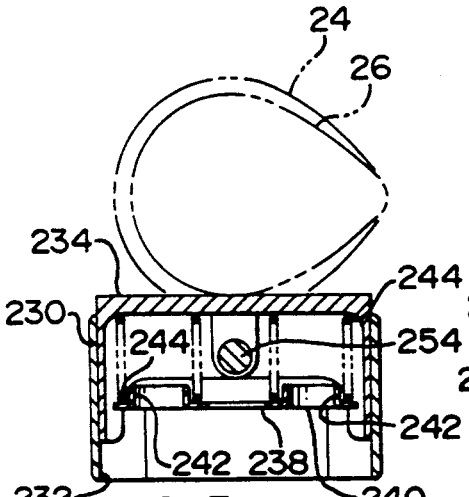
FIG 15
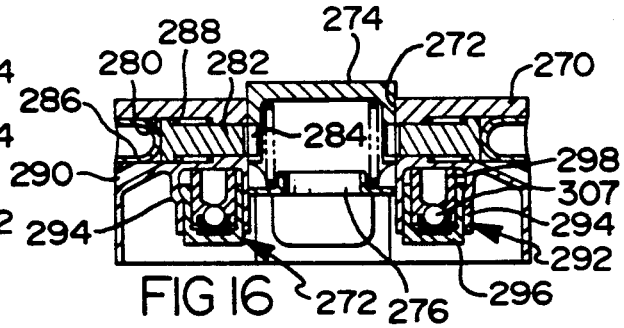
FIG 16
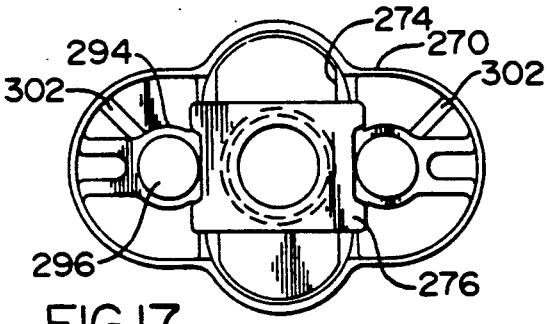
FIG 17
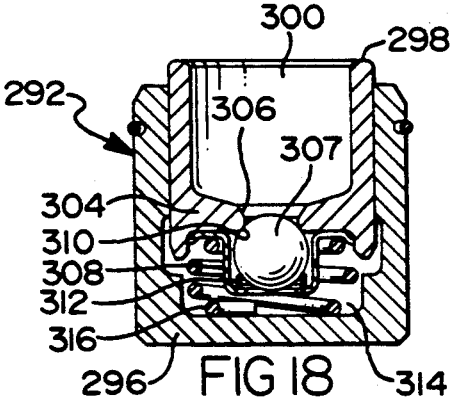
FIG 18

TWO-STEP VALVE OPERATING MECHANISM

FIELD OF THE INVENTION

This invention relates to valve operating mechanisms for internal combustion engines and particularly to such mechanisms having selective high lift and low lift capabilities.

BACKGROUND OF THE INVENTION

The intake and exhaust valves of an engine ideally are operated by cams and return springs to open at the right time and for a correct amount and duration to achieve the desired engine operation. Because the optimum cam profile for one engine condition, e.g. low speed, is much different than the optimum profile for another condition, e.g. high speed, various arrangements have been proposed to vary the valve opening as a function of the engine speed, load, or other parameter.

One such prior art proposal is to employ separate low lift and high lift cams with separate lifters, each lifter independently mounted in a carrier block and each acting on a different valve. In particular, two low lift tappets, one on either side of a single high lift tappet, independently operates each of two valves. The low lift tappets would always be operatively coupled to the valves while the high lift tappets would just idle during low speed operation. For high speed conditions, a locking mechanism couples the low and high lift tappets such that the action of the high lift cam overrides the low lift cams to control the low lift tappet and the valves for movement together. The locking mechanism comprises pins in the low lift tappets which must slide into holes in the high lift tappet thereby requiring tight tolerances in the three cooperating tappets Further tight tolerance requirements apply to the cam carrier which must have accurately positioned bores for each of the three tappets.

SUMMARY OF THE INVENTION

It is therefore an object of the invention to provide a two step cam arrangement having only two tappets for each set of cams and only one of the tappets being slidably supported by a cam carrier. A further object is to provide a lifter assembly having two tappets and the ability to lock the tappets together without sliding a pin into a hole. Still another object is to provide a camshaft configuration for the two-step arrangement which is easily machined with accuracy.

The invention is carried out in a valve operating mechanism for two-step lifter operation by: carrier means for movably holding a valve lifter; camshaft supported by the carrier and including high lift and low lift cam means: and a two-step valve lifter supported by the carrier for selective operation by the high lift cam means and the low lift cam means comprising; the lifter including a first lifter element mounted for reciprocating movement on the carrier means for engagement by the low lift cam means, a bore in the first lifter element, a second lifter element mounted in the said bore for reciprocating movement in the bore and for engagement by the high lift cam means, and locking means for selectively locking the second lifter element to the first lifter element whereby when the locking means is in locked condition the first lifter element is controlled by the high lift cam means, and when the locking means is in unlocked condition the first lifter element is controlled by the low lift cam means.

BRIEF DESCRIPTION OF THE DRAWINGS

The above and other advantages of the invention will become more apparent from the following description taken in conjunction with the accompanying drawings wherein like references refer to like parts and wherein:

FIG. 1 is a cross-sectional side view of the front portion of a cam carrier and cover including a camshaft and valve lifter, according to the invention, FIG. 2 is a top view of FIG. 1 with the camshaft and cover removed, FIG. 12 is a partial cross-sectional view of a camshaft, valve lifter, valves and engine head according to a third embodiment of the invention, FIG. 13 is a cross-sectional side view of a valve lifter according to a fourth embodiment of the invention, FIGS. 14 and 15 are cross-sectional side and end views of a valve lifter according to a fifth embodiment of the invention, FIG. 16 is a cross-sectional side view of a valve lifter according to a sixth embodiment of the invention, FIG. 17 is a bottom view of the lifter of FIG. 16, FIG. 18 is a cross-sectional detail of a hydraulic lash adjuster for the lifter of FIG. 16.

DESCRIPTION OF THE INVENTION

Figure 3:
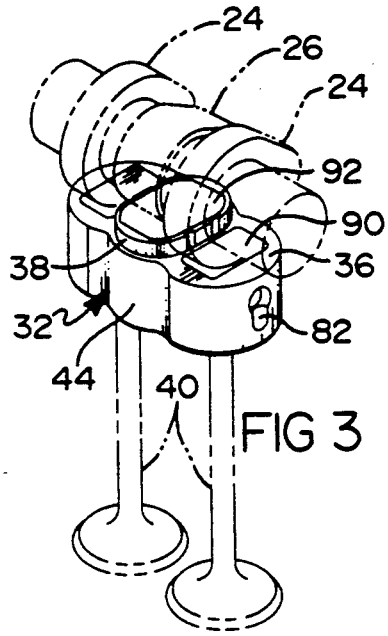
FIG. 3 is an isometric view of the lifter of FIG. 1 and valves according to the invention.

The ensuing description is for a valve operating mechanism especially designed for an overhead camshaft engine having four valves per cylinder, the intake valves operating in unison and the exhaust valves likewise operating in unison, each pair of valves being actuated by a single lifter. A set of two low lift cams and one high lift cam, operating on the lifter, actuate either the intake valves or the exhaust valves. It will be apparent that the invention is not limited to that specific application. For example, the lifter could be used to operate a single valve for two-step valve control in an engine having two valves per cylinder. Also, the invention can be adapted to cam-in-head engines and to cam-in-block engines with push rods, for example.

A first embodiment is shown in FIGS. 1–7. Referring to FIGS. 1 and 2 of the drawings, a camshaft carrier 10 supported on a cylinder head, not shown, has an upper side 12 closed by a cover 14. Together, the carrier 10 and cover 14 enclose a camshaft compartment 16 sealed at the joint by suitable means and containing an overhead camshaft 18.

The camshaft is rotatably supported on webs 20, 22 of the carrier 12 and cover 14 respectively. Camshaft bearings, not shown, may be formed by machined portion of the webs or, if desired, could be comprised of separate inserts. Camshaft 18 includes a plurality of low lift cams 24 and high lift cams 26. The low lift cams 24 are arranged in pairs on opposite sides of the high lift cams 26.

Beneath each set of cams 24, 26, the carrier 10 contains an elongated bore 28 with semicylindrical ends 30 and its major axis extending parallel to the camshaft 18. The semicylindrical ends preferably subtend an arc greater than 180 degrees. Between the ends 30 the bore has a midsection 31 which necks down adjacent each end 30 and curves outwardly in a cylindrical surface to become larger in the center 34, having a width comparable to the diameter of the ends 30 or which may be somewhat larger than that diameter.

A valve lifter 32 resides in the bore 28 for reciprocating sliding movement therein. As shown in FIG. 3, the valve lifter 32 comprises two lift elements or tappets: an outer tappet 36 which is operably engaged on its top by the cams 24, and an inner tappet 38 which is operably engaged on its top by the cam 26. The bottom of the outer tappet 36 bears against the stems of a pair of valves 40. The outer tappet 36 is elongated to fit lengthwise in the bore 28 and has semicylindrical ends 42 which slidably fit against the ends 30 of the bore 28. The tappet 36 midsection 44 is shaped somewhat like the bore midsection 31 but is sufficiently smaller to define a spacing between the bore and the tappet midsections. Thus the only contact between the bore 28 and the outer tappet 36 are the semicylindrical ends 30 and 42 which are easily fabricated to the correct tolerance. The resulting half cylinder bearing surfaces are able to take lateral thrust in any direction to assure a stable operation. The lateral forces imposed by cam action on the tappet are taken up by side thrust on both ends of the spaced bearing surfaces. Because the bore and tappet are elongated, the tappet is held against rotation. Further, since all the major surfaces are cylindrical, machining or other fabrication of the bore is simplified.

Figure 4:
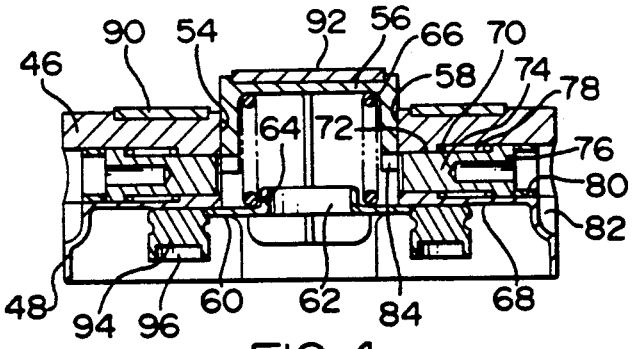
FIGS. 4 and 5 are cross-sectional side and end views, respectively, of the lifter of FIG. 3.
Figure 6:
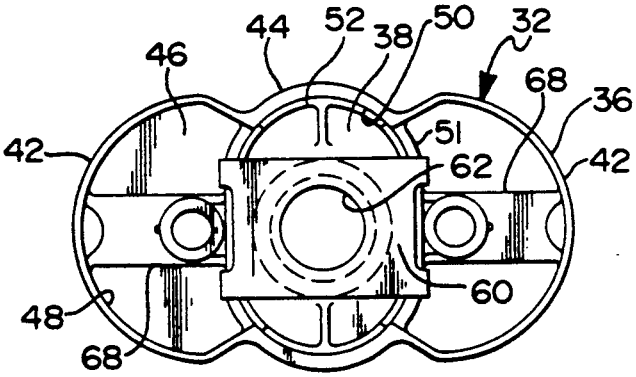
FIG. 6 is a bottom view of the lifter of FIG. 3.
Figure 5:
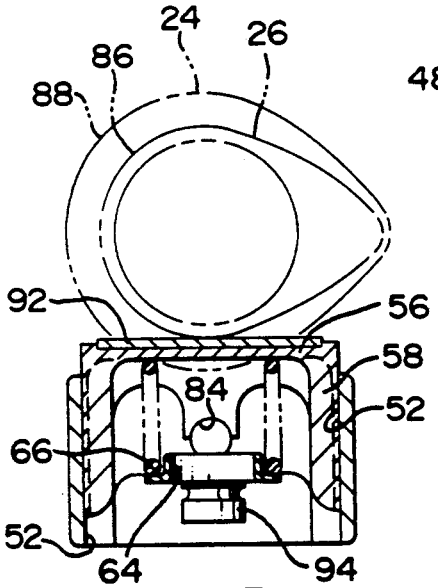

Detailed FIGS. 4, 5 and 6 show the outer tappet 36 with top 46 supporting a depending skirt 48 which extends around the tappet periphery. An elongated bore 50 in the center of the tappet 36 defined by a bore wall portion 51 has its major axis extending normal to the camshaft axis. The bore 50 has semicylindrical ends 52 connected by planar sides 54. The inner tappet 38 has the same shape as the bore 50 and slidably fits within the bore 50. The tappet 38 has a top 56 and sidewalls 58 which engage the bore 50. A sheet metal spring retainer 60 is secured across the bottom of the bore 50 by welding to the bottom of bore wall portion 51, for example, or by corner tabs, not shown, which are bent over a rib on the wall portion 51. The retainer 60 has a central aperture 62 surrounded by an upturned flange 64. A coil compression spring 66 within the tappet 38 fits over the flange 64 and seats against the retainer 60 at one end and bears against the tappet top 56 at the other end to bias the tappet 38 upwardly against the cam 26. In the absence of a locking mechanism, to be described, the inner tappet 38 is thus free to reciprocate in the bore 50 under action of the high lift cam 26.

To selectively lock the inner and outer tappets together, a lock arrangement comprises a pair of cylinders 68 integral with the tappet 36 and extending from the bore wall portion 51 to the respective end walls 42. The cylinders 68 each have a stepped bore defining a shoulder 70 and a reduced diameter portion 72 at the inner end of the cylinder. A locking pin 74 in each cylinder 68 has a body diameter which slidably fits in the cylinder portion 72 and a head 76 which slidably fits in the outer end of the cylinder. A coil spring 78 around the body of the pin 74 bears against the shoulder 70 and the head 76 to bias the pin outward. An annular stopper 80 in the outboard end of each cylinder 68 limits the outer travel of the pin 74 to retain the pin in the bore. The outboard end of each cylinder terminates in a vertically oblong oil passage 82 in the end 42 of the outer tappet 36 which communicates with an oil gallery in the carrier 10 to be described. The side walls 58 of the inner tappet 38 are shaped to form saddle-shaped stops 84. The stops 84 are located above the cylinders 68 when the tappet 38 is in its upper position to just clear the pins 74 when the pins 74 are extended into the inner tappet 38. When the pins are extended by application of oil pressure to passage 82, the stops 84 engage the pins 74 so that the inner tappet is no longer able to reciprocate in the bore 50 and the outer tappet 36 is locked to the inner tappet for movement together under action of the high lift cam.

As shown in FIG. 5, the base circle 86 of the high lift cam 26 is smaller than the base circles 88 of the low lift cams 24 and the profile of the high lift cam 26 fits within the envelope defined by the profiles of the two low lift cams 26. This provides a distinct manufacturing advantage since it is desirable that the two low lift cams be the same and they can be ground at the same time for improved accuracy without interfering with the high lift cam 26. Since the base circle 86 is smaller than the base circle 88, the tappet 38 is higher than the tappet 36 when both are in contact with their respective base circles.

Wear pads 90, 92 are set in recesses in the tops of the low lift tappets 36 and high lift tappets 38 respectively. The cams slidably contact the wear pads which are selected of preferred alloys for optimum wear. The pad 92 is also useful for lash compensation for the high lift tappet 38. The compensation is effected by selecting a pad thickness which is sufficient to take up undesired clearance. Of course the wear pads 90 could be selected for lash compensation in the low lift cams, but it is preferred to use lash caps 94 which are inserted between the bottom of the tappet 36 and the tops of the valves 40, the caps being sized to compensate for the low lift lash. Each lash cap 94 is a cylindrical element with a recess 96 in its lower surface for receiving the upper end of a valve stem. The lash caps are not secured to the lifter 32 but are shown in FIG. 4 to illustrate the location of the caps when the valve train is assembled. It is thus seen that the cap locations are equally spaced from the ends 42 of the outer tappet 36 outboard of the bore 50 It will thus be seen that the forces on the lifter 32 tend to be balanced. The valves 40 are spaced equidistant from the center. The cam force is delivered either by the high lift cam at the center of the lifter or by two low lift cams equidistant from the center.

Figure 7:
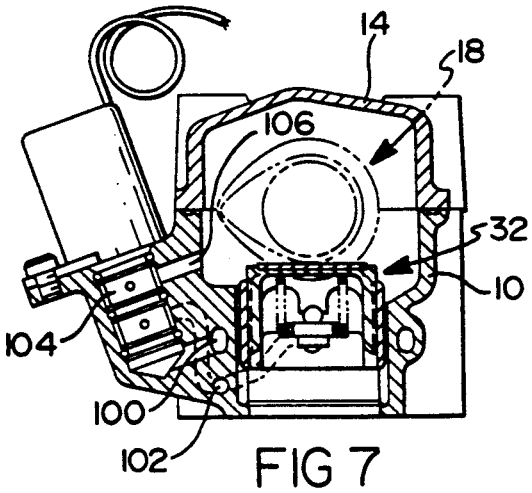
FIG. 7 is a cross-sectional end view of the assembly of FIG. 1.

Referring to FIGS. 1, 2 and 7, an oil passage 100 in the carrier 10 is supplied continuously with pressurized engine oil to lubricate the camshaft bearings and lifter bores 28. A second oil passage 102 in the carrier 10 feeds oil to the passages 82 in the outer tappets for controlling the locking mechanism. The oil pressure from the passage 100 is admitted by a solenoid controlled valve 104 to the passage 102 when the solenoid is energized. In the deenergized state, the valve 104 isolates the passage 100 from passage 102 and relieves oil pressure from the passage 102 to a drain 106. The main extent of the oil passage 102 is lower than the drain 106 to prevent draining excess oil from that passage, thereby keeping the passage filled and ready for rapid application of pressure when the solenoid valve 104 is energized.

Thus energizing valve 104 causes oil pressure to advance the locking pins 74 into the inner tappet 38 beneath the saddle-like stops 84 when both tappets are in contact with the base circles of their respective cams. Because the high lift cam profile has a higher lift than the low lift cam, it will control the movement of both the outer and inner tappets 36, 38 to obtain maximum opening of the valves 40 as shown in FIG. 1. Deenergizing valve 104 relieves the pressure, allowing the springs 78 to retract the pins 74 from the stops 84, when the tappets are in contact with their base circles, to unlock the tappets so that only the low lift cams 24 are effective to move the outer tappet 36 and the valves 40. When unlocked, the inner tappet still moves in response to the high lift cam but it merely idles in the bore 50 and has no effect on the outer tappet 36. Regardless of the cam angle at which the valve is actuated, the actual switching between high and low lift occurs only when the tappets are on the base circles, thereby avoiding sudden impacts or changes in velocity of valve train components which are unacceptable due to noise and wear of components.

A similar tappet arrangement with a different locking mechanism is shown in FIGS. 8–11. The outer tappet configuration is the same as described above and includes the wear pads 90, 92 to contact the cams. The outer tappet 110 has a web 112 across the tappet body near the bottom and a central aperture 114 in the web which retains the lower end of a cylindrical sleeve 116. The upper end of the sleeve 116 extends into the inner tappet 118. The sleeve 116 has a closed lower end and an oil passage 120 in the lower end which is coupled through radial ports 122 to oil passages 124 in the web 112 which passages extend to the ends of the tappet 110. A spool 126 which is axially slidably in the sleeve 116 has an inner stem 127, a radially extending upper flange 128 extending across the sleeve bore and a lower head 130 extending across the sleeve bore, the lower head having an upper ramp surface 132 sloping upward to the stem 127. Lateral apertures 134 (one shown) are in the sleeve opposite the stem 127 when the spool 126 is in its lower position in the sleeve 116. A ball 136 partially fits in each aperture, the ball diameter being greater than the sleeve thickness such that the ball may partially reside adjacent the stem 127 between the upper flange 128 and the ramp surface 132. A coil spring 138 compressed between the top of the spool 126 and the inner surface of the top of the inner tappet 118 biases the spool to the lower position.

An outer sleeve 140 slidably surrounding the sleeve 116 in telescoping manner is urged against the top of the inner tappet 118 by a coil spring 142 which is seated on the web 112. When the inner tappet 118 is in contact with the base circle of the high lift cam 26, the lower end of the sleeve 140 terminates just below the centerline of the aperture 134 in the sleeve 116 and contains at the end an internal annular relieved portion which slopes upward and inward to form a pocket 144 adapted to partially receive the balls 136 when the balls are pushed out of the sleeve 116.

Figure 10:
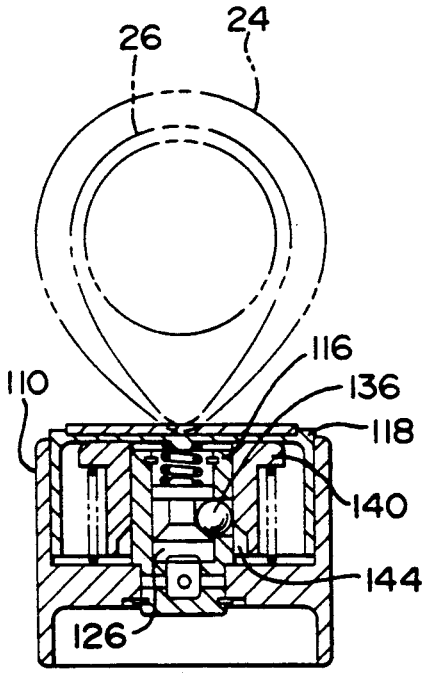
Figure 11:
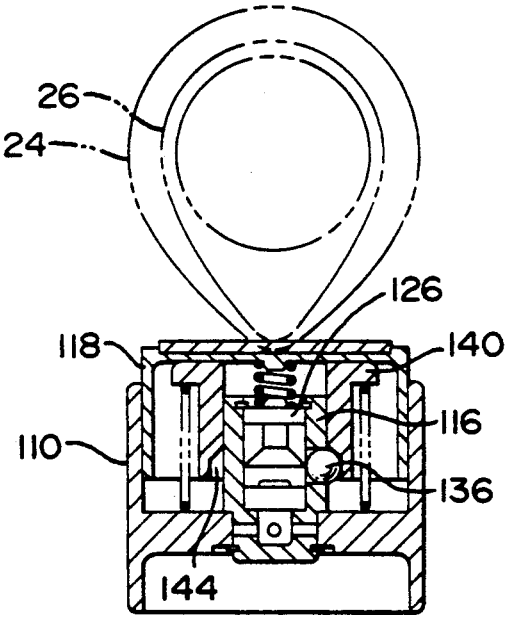

In operation, when no oil pressure is applied to the passage 124, the spool 126 remains in its lower position and the balls 136 remain in the confines of the sleeve 116 or are pushed in by the slope of the pocket 144. Then as the high lift cam 26 pushes down on the inner tappet 118 the outer sleeve 140 is free to telescope over the inner sleeve 116 as shown in FIG. 10 and the tappet 110 motion is controlled by the low lift cam. When, however, oil pressure is applied to the passage 124 and into the passage 120, the spool is pushed by the pressure upwardly in the sleeve 116 and the ramp surface 132 pushes the balls 136 out of the inner sleeve 116 and partially into the pocket 144 (assuming the cams are riding on the base circles of the cams). Then the balls engage both the aperture 134 of the inner sleeve 116 and the pocket 144 of the outer sleeve 140 to lock the sleeves and thus the tappets against relative movement, as shown in FIG. 11. In that case, the outer tappet 110 will move under control of the high lift cam.

FIG. 12 shows a lifter 150 employing essentially the same locking mechanism as described above for FIGS. 8–11 but having other features of interest. The outer tappet 152, rather than being contained in a bore of the cam carrier, is supported for vertical movement on two posts 154 extending from the head 156 and sliding in vertical bores 158 near either end of the tappet 152. The pins are located outboard of the valves 40 which engage the bottom of the outer tappet 152. Valve springs 40' provide the force to urge the lifter 150 against the cams 24' and 26' of the camshaft 18. In this version the high lift cam 26' extends beyond the envelope of the low lift cams 24'. Roller followers 160 are mounted on the outer tappet 152 and the inner tappet 162 instead of wear pads for low friction contact with the cams. The inner tappet 162 comprises an outer sleeve 164 reciprocably slidable in a bore 166 of the outer tappet 152. A roller follower 160 is mounted near the top of the sleeve 164 by means of a roller axle 168 which extends through holes 170 in the sleeve to a compression spring 172 which pushes on the axle to urge the tappet 162 against the cam 26'. The spring 172 is contained in an annular groove 174 surrounding the bore 166 in the outer tappet 152.

Figure 8:
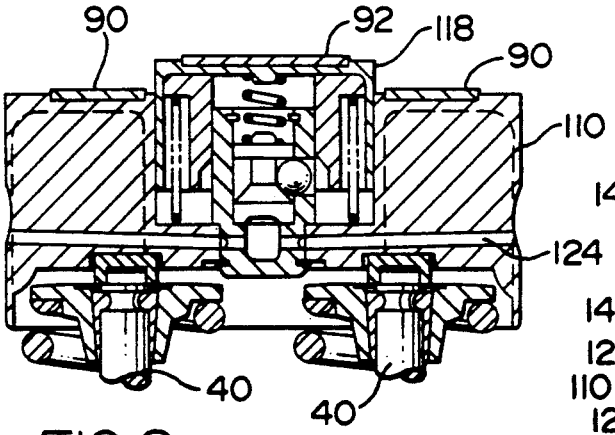
FIG. 8 is a cross-sectional side view of a valve lifter according to a second embodiment of the invention.
Figure 9:
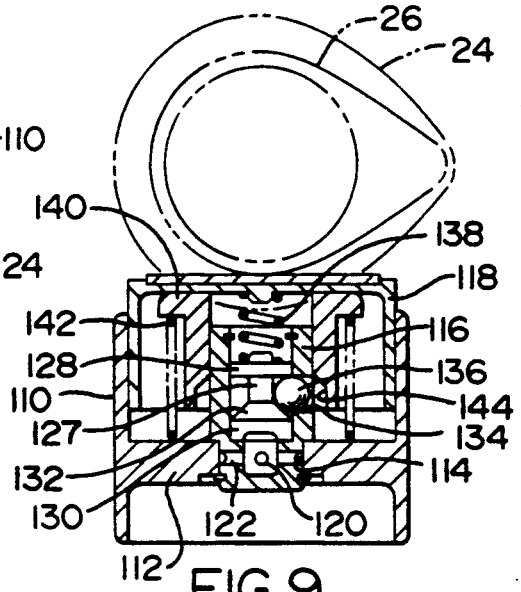
FIGS. 9–11 are cross-sectional end views of the lifter of FIG. 8 for valve-closed, low-lift valve-open, and high-lift valve-open conditions of the lifter.

The locking mechanism is similar to that of FIG. 8. A web 176 extends across the sleeve interior to provide a spring seat for spring 138 which depresses spool 126 against the bottom of an inner sleeve 116'. The lower end of the outer sleeve 164 has a pocket 144 which can partially receive balls 136 which partially reside in an aperture in the sleeve 164. A hole 178 in the bottom of the sleeve 116' communicates with oil passages 180 which extend through the tappet 152 to the bores 158. Each post 154 contains an oil passage 182 which connects to an oil gallery (not shown) in the head 156. When oil pressure is applied the spool 126 moves up to force the balls partially into the pocket 144 to thereby lock the outer sleeve against movement relative to the outer tappet so that the high lift cam 26' controls the lifter movement. When oil pressure is removed, the balls return to the inner sleeve 116' to allow free reciprocation of the inner tappet 162 within the outer tappet 152.

Still another embodiment of a locking mechanism for tappets is illustrated in FIG. 13. An elongated outer tappet 190 has a bore 192 containing a reciprocable inner tappet 194 generally in the manner of the first embodiment. Webs 196 in each end of the tappet 190 outboard of the bore 192 support a bridge element 198 extending across the bore beneath the inner tappet 194. The bridge 198 contains a cylindrical passage 200 having one end coupled to an oil passage 202 extending through a web 196 to an end of the tappet 190. A spring 204 is compressed between the bridge 198 and the top of the inner tappet 194 to bias the tappet 194 in the upper direction. A cylinder 206 extends upward from the bridge inside the spring 204 and terminates below the top of tappet 194 to allow movement of the tappet. A hollow piston 208 slidably fits within the upper end of the cylinder to define a chamber 209 at the lower end of the cylinder and is spring biased down into the cylinder by a spring 210 within the piston. A small opening 212 in the top of the passage couples the cylinder to the passage through a ball check valve 214 situated to permit fluid flow only into the chamber 209. A drain passage 216 connects the chamber to the end of the passage 200 opposite the oil passage 202 and an exhaust port 218 is disposed in the passage 200 near its junction with the drain 216. A shuttle valve comprises a pin 220 slidable in the cylindrical passage 200 between a first position which blocks fluid flow through the opening 212 and a second position which blocks fluid flow from the drain 216. A spring 222 in the passage 200 between the pin 220 and a plug 224 in the end of the passage 200 biases the pin to the first position.

In operation, when no fluid pressure is applied through the oil passage 202 the pin 220 is spring biased to its first position to drain fluid from the chamber 209 thus allowing the piston 208 to be depressed in the cylinder. In that condition the inner tappet is free to reciprocate in the bore 192 under action of the high lift cam (not shown) so that the outer tappet 190 is controlled only by low lift cams. When oil pressure is applied, the pressure moves the pin 220 to its second position which blocks the drain 216 and permits flow into the chamber 209 through the check valve 214. Flow into the chamber is permitted when the inner tappet 194 is in contact with the base circle of the high lift cam at which time the check valve can be displaced from its seat. When the lobe on the cam contacts the tappet 194 to push it down, the check valve prevents flow from the chamber through the opening 212. Thus the chamber 209 becomes filled to lock the two tappets together and the action of the high lift cam is transferred to the outer tappet and the valves through lash caps 226.

An additional embodiment of the invention with yet another locking mechanism is set forth in FIGS. 14 and 15. An elongated outer tappet 230 has a transversely elongated bore 232 containing a reciprocable inner tappet 234. Walls 236 defining the bore 232 support at their bottom end a retainer 238 which is welded or crimped to the walls. The retainer 238 has two spaced apertures 240 at either side of the retainer center, each aperture being surrounded by an upturned flange 242. Coil springs 244 seated on the retainer 238 and around the flanges 242 bear against the top of the inner tappet 234 to urge it upward with respect to the outer tappet 230.

A locking mechanism includes a bore 246 extending end to end through the outer tappet 230. The bore 246 contains a first slidable pin 248 on one side of the tappet 234 retained by a plug 250 which seals an outboard end of the bore 246. When one end of the pin 248 abuts the plug 250, the other pin end is flush with the interface of the bore 232 and inner tappet 234. A second pin 252, aligned with the first pin when the tappets are in contact with the base circles of the cams 24, 26, is slidably carried in apertures 254 in the walls of the inner tappet 234, the length of the second pin 252 being equal to the width of the tappet 234 so that the pin ends are flush with the tappet walls. A third slidable pin 256 is stationed in the bore 246 adjacent the other side of the tappet 234 and is biased toward the second pin by a coil spring 258 which is retained by a tubular plug 260 at the outer end of the bore 246. An oil passage 262 inclined to the bore 246 intersects the bore 246 at the inboard end of the plug 250 and extends to the end of the tappet 230 at a point below the plug 250.

In operation, the oil passage 262 supplies oil pressure to the outer end of the first pin and pushes that pin as well as the other pins toward the spring 258 with the result that the first and second pins 248, 252 bridge the interface between the tappets 230, 234 to lock the tappets for movement together. When oil pressure is removed, the spring 258 pushes the pins back toward the plug 250 so that the pin ends are flush with the tappet interface and the inner tappet 234 is free to reciprocate in the outer tappet.

The embodiment of FIGS. 16 and 17 is much like the first embodiment but it includes built-in hydraulic lash adjusters and has a different oil passage arrangement. An outer elongated tappet 270 has a transverse elongated bore 272 which holds an inner tappet 274 slidably mounted therein. A spring retainer 276 secured to the bottom of the bore 272 traps a spring 278 between the retainer and the top of the inner tappet 274 to push the inner tappet up relative to the outer tappet 270 to engage the high lift cam. Longitudinal bores 280 in either end of the outer tappet contain slidable pins 282 which are aligned with holes 284 in the wall of the inner tappet 274 for entering the holes when the pins are advanced. If desired, stops on the lower wall of the inner tappet can be used to engage the pins instead of the holes 284. The outer ends of the bores 280 are sealed with plugs 286 to retain the pins and prevent fluid leakage. Each pin 282 is biased outwardly by a spring 288 which surrounds the pin. An inclined oil passage 290 at each end of the outer tappet intersects a respective bore 280 at the inner end of the plug and extends to the end of the outer tappet at a point below the plug 286. The locking mechanism operates in the same way as in the first embodiment: when oil pressure is applied to the oil passages 290 the pins 282 are pushed into engagement with the inner tappet 274 to lock the tappets together.

A pair of hydraulic lash adjusters 292 of conventional construction are incorporated into the body of the outer tappet 270. Below the bores 280, closed-end cylinders 294 are formed integral with the tappet. Each cylinder 294 slidably holds a closed end piston 296 which operatively engages a valve stem (not shown) at its closed end. The open end of the piston 296 receives a plunger 298 which engages the tappet 270 body. The plunger is hollow in its upper end and forms a reservoir chamber 300 which is supplied with pressure oil by an oil passage 302 (FIG. 17). As is better shown in FIG. 18, the plunger 298 has a transverse wall 304 near its lower end and an orifice 306 extends through the wall 304. A ball check valve controlling flow through the port 306 comprises a ball 307 held below the port by a cage 308, a seat 310 around the lower side of the orifice, and a spring 312 between the cage and the ball which urges the ball against the seat to prevent flow up through the orifice. The space between the plunger wall 304 and the bottom of the piston 296 comprises a high pressure chamber 314. A coil spring 316 in the pressure chamber 314 urges the plunger 298 up relative to the piston 296. Whenever any lash is present while the lifter engages the cam base circles, the spring 316 pushes the plunger 298 and the piston 296 apart to remove the lash and fluid flows through the port 310 to keep the pressure chamber 314 full. Any fluid lost between the sliding surfaces of the piston 296 and the plunger 298 as "leak-down"

during valve opening action is replaced by flow through the orifice 310 during the lash adjusting action.

Figure 19:
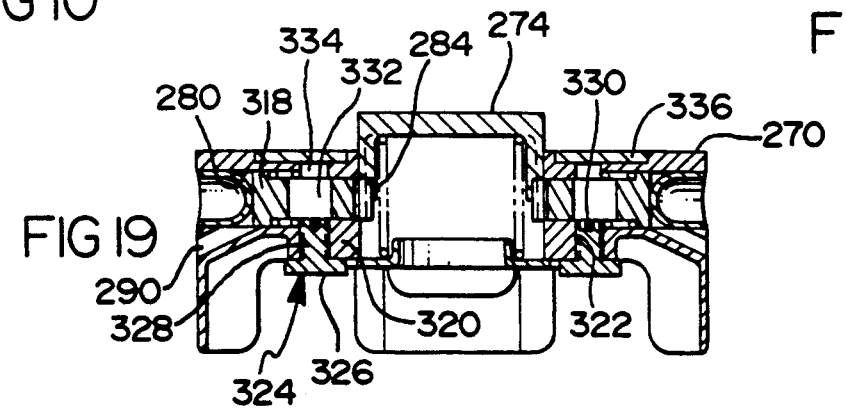
FIG. 19 is a cross-sectional side view of a valve lifter according to a seventh embodiment of the invention.

A valve lifter similar to that of FIG. 16 except with mechanical lash adjusters is shown in FIG. 19. An outer tappet 270 contains an inner tappet 274 and a horizontal bore 280. Locking pins 318 are aligned with holes 284 (or just beneath a stop) and are slidable to locking position under fluid pressure introduced through passages 290. The outer tappet lower surface 320 has a pair of vertical threaded holes 322 which extend to the horizontal bore 280 just under the pins 318. Each hole 322 holds a lash adjuster 324 which consists of a cylindrical button-like body 326 for engaging a valve stem (not shown) and a vertical threaded stem 328 which screws into the threaded hole 322. It will be apparent that the lash may be compensated for by rotating the adjuster 324 to move the body 326 axially of the threaded stem 328. To permit such rotation, the upper end of the adjuster stem 328 contains a hexagonal socket 330 for receiving an Allen wrench. For insertion of such a wrench, each locking pin 318 has a slot 332 aligned with the stem 328 for any axial position of the pin, and the upper surface of the outer tappet 270 also has holes 334 aligned with the stem 328. The wear pads 336 on the top of the tappet 270 cover the aperture but are removed when tool access to the lash adjuster is required.

Figure 20:
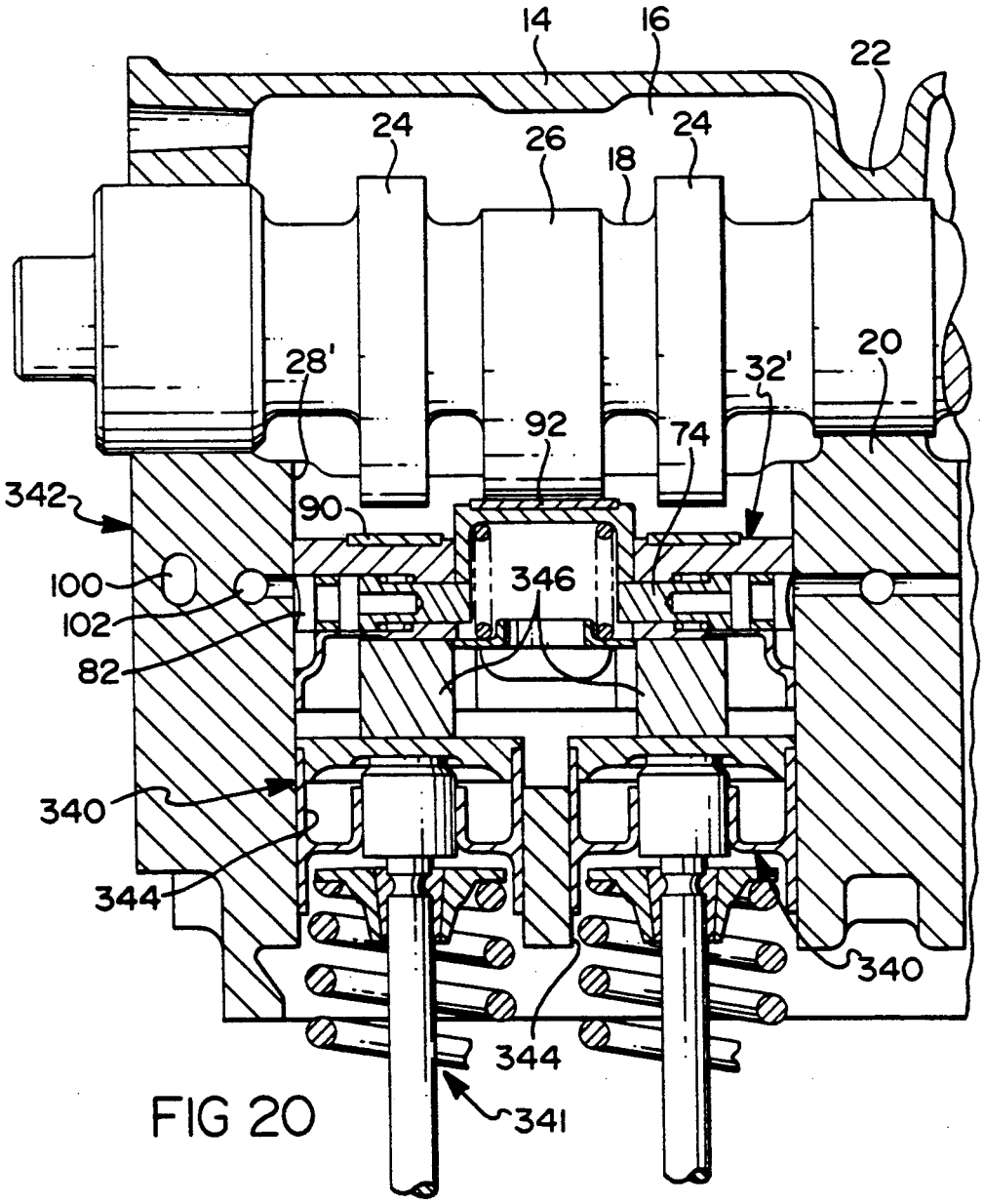
FIG. 20 is a partial cross-sectional view of a cam, carrier and lifter arrangement for converting a conventional valve train to a two step concept, according to the invention.

FIG. 20 illustrates a portion of an engine which has been converted from a conventional lifter arrangement to incorporate the two-step lifter concept. The original lifters 340 of the conventional direct acting type which slide in round bores, the associated valve assemblies 341 and the cam cover 14 are the only items in the drawing which remain from the original engine. To make the conversion, the cam cover 14 is temporarily removed, and the cam carrier and cam shaft are removed and replaced by a new camshaft 18, and a 20 new cam carrier 342 containing lifters 32'. The lifters 32' are housed in the upper section of the carrier 342 in an elongated bore 28' which is like the bore 28 of FIGS. 1 and 2 and extends only partially through the carrier 342. A pair of round bores 344 in the lower section of the carrier and aligned with and connecting with the bore 28' contain the original lifters 340. The bores 344 and lifters 340 are equally spaced from the ends of the elongated bore 28'. The two-step lifters 32' include locking pins 74 and are the same as the lifters 32 of FIGS. 1–6 except for a pair of lower appendages 346 aligned with and in operating contact with the lifters 340. When the elongated lifter 32' is operated by either the high lift or the low lift cams according to the position of locking pins 74, the original lifters 340 will be operated by the same amount.

It will thus be seen that the proposed valve lifter configuration may be expressed as a variety of embodiments, not limited to those described herein, all within the spirit of the invention. The advantages of the invention include ease of manufacture of the camshaft, the carrier and the lifter with accurate tolerances, improved synchronous valve operation due to a single lifter operating two valves, improved lash adjustment capability for a two-step lifter, and improved locking of high lift and low lift tappets.

The embodiments of the invention in which an exclusive property or privilege is claimed are defined as follows:

1. In a valve operating mechanism for two-step lifter operation:

support means for movably holding a valve lifter;

a camshaft supported adjacent the valve lifter and including high lift and low lift cam means; and a two-step valve lifter supported by the support means for selective operation by the high lift cam means and the low lift cam means;

the lifter including a first lifter element for engagement by the low lift cam means and mounted on the support means for uniform reciprocating movement along a straight path, a bore in the first lifter element, a second lifter element mounted in the said bore for reciprocating movement in the bore and for engagement by the high lift cam means, and locking means for selectively locking the second lifter element to the first lifter element whereby when the locking means is in locked condition the first lifter element is controlled by the high lift cam means, and when the locking means is in unlocked condition the first lifter element is controlled by the low lift cam means.

2. The invention as defined in claim 1 wherein the first lifter element is elongated and has spaced apart cam contact portions on opposite sides of the said bore;

the high lift cam means comprises a single cam in contact with the second lifter element and the low lift cam means comprises a pair of cams on either side of the high lift cam for engaging the spaced apart cam contact portions on the first lifter element.

3. The invention as defined in claim 2 wherein:

the profile of the low lift cams defines an envelope and has a first base circle, and the profile of the high lift cam is within the said envelope and has a second base circle of smaller diameter than the first base circle; and when the lifter elements are in contact with the base circles of the respective cams the second lifter element extends above the contact portions of the first lifter element.

4. The invention as defined in claim 2 wherein when the lifter elements are in contact with the base circles of the respective cams the contact portion of the second lifter element extends substantially above the contact portions of the first lifter element.

5. The invention as defined in claim 1 wherein the cam means each have a base circle portion in contact with respective lifter elements during a valve-closed condition, and wherein the locking means includes a first sleeve mounted for movement with the second lifter element, a second sleeve attached to the first lifter element and mounted to telescopically slide within the first sleeve, an aperture in the second sleeve, a pocket in the first sleeve aligned with the aperture when the lifter elements are in contact with the respective base circles, a ball residing partially within the aperture, and an actuator within the second sleeve for moving the ball into the said pocket to block relative movement between the first and second sleeves to thereby lock the second lifter element to the first element for movement together.

6. The invention as defined in claim 5 wherein the actuator is a spool axially slidable in the second sleeve and spring biased toward unlocking position and selectively hydraulically operated to locking position, the spool having a recess for partially receiving the balls and a sloped surface for camming the balls into the said pocket upon hydraulic operation of the spool.

7. The invention as defined in claim 1 wherein the locking means comprises a closed end cylinder supported by the first lifter element and located within the second lifter element with an open end facing the second lifter element, a piston slidably mounted in the cylinder and adapted to bear on the second lifter element, the piston and cylinder closed end defining a chamber therebetween, hydraulic means including a check valve for filling the chamber to hold the piston against the second lifter element to lock the elements together, the hydraulic means including valve means coupled to the cylinder to selectively empty the chamber and permit relative movement between the elements, and means for operating the valve means whereby the first and second lifter elements are selectively locked and unlocked.

8. The invention as defined in claim 7 wherein a cylindrical passage feeds hydraulic fluid to the chamber through one end of the passage and exhausts fluid from the chamber through the other end of the passage;

a drain extending from the chamber to the said other end of the passage;

the valve means comprising a shuttle valve including a pin in the cylindrical passage slidable between a first position which blocks the drain and allows flow to the chamber and a second position which unblocks the drain, the pin being moved by hydraulic pressure in the passage to the first position for filling the chamber and spring means for moving the pin to the second position in the absence of hydraulic pressure in the passage to drain fluid from the chamber whereby the first and second elements are locked and unlocked according to applied hydraulic pressure.

9. The invention as defined in claim 1 wherein the locking means comprises a pin means slidably mounted in the first lifter element for selectively extending into the second lifter element, and the second element having a lower surface comprising stop means for abutting the pin means to effect movement of the first and second elements in concert by the high lift cam when the pin means is extended.

10. The invention as defined in claim 1 wherein the second lifter element has means for adjusting lash comprising a wear pad on the surface of the second lifter for engagement by the high lift cam, the thickness of the wear pad being selected to compensate for lash.

11. A valve operating mechanism comprising:

a camshaft having sets of cams, each set including high and low lift cam means;

a cam carrier supporting the camshaft;

a plurality of elongated bores in the cam carrier, each bore being opposite a set of cams and extending parallel to the camshaft;

a valve lifter in each bore;

each valve lifter comprising an elongated low lift tappet slidably fit in its respective bore and engaging low lift cam means and valve actuating means, an oblong bore in each low lift tappet extending normal to the camshaft, an oblong high lift tappet slidably fit in each oblong bore for reciprocating movement in the bore and spring biased against the high lift cam means, and means for selectively locking the high lift tappets to the respective low lift tappets effective when locked to move the low lift tappets with the high lift tappets under control of the high lift cams and when unlocked to permit the high lift tappets to reciprocably idle in the oblong bores of the low lift tappets.

12. The invention as defined in claim 11 wherein each elongated bore and the elongated low lift tappet have mating semicylindrical ends comprising slidable bearing surfaces for assuming side thrust and guiding tappet movement in the cam carrier.

13. The invention as defined in claim 1 wherein the first lifter element has a surface on the opposite side of the lifter from the camshaft, threaded apertures in the surface, and lash adjusters having threaded stems secured in the respective threaded apertures for lash adjustment by stem rotation.

14. The invention as defined in claim 13 wherein each threaded stem has a tool engaging portion and the first lifter element has tool access openings aligned with the tool engaging portion to facilitate adjustment of the lash adjuster.

15. The invention as defined in claim 11 wherein each elongated bore in the carrier extends partially through the carrier, the carrier including cylindrical bores aligned with and connected with the elongated bores, and wherein the valve actuating means comprises cylindrical tappets in the cylindrical bores operatively engaging the low lift tappets.

16. The invention as defined in claim 15 wherein two cylindrical bores are aligned with each elongated bore and equally spaced from the ends of the elongated bore.

17. In a valve operating mechanism for two-step lifter operation:

support means for movably holding a valve lifter;

a camshaft supported adjacent the valve lifter and including high lift and low lift cam means; and a two-step valve lifter supported by the support means for selective operation by the high lift cam means and the low lift cam means;

the lifter including a first lifter element for engagement by one of the high and low lift cam means and mounted on the support means for uniform reciprocating movement along a straight path, a bore in the first lifter element, a second lifter element mounted in the said bore for reciprocating movement in the bore and for engagement by the other of the high and low lift cam means, and locking means for selectively locking the second lifter element to the first lifter element whereby when the locking means is in locked condition both lifter elements are controlled by the high lift cam means, and when the locking means is in unlocked condition one of the lifter elements is controlled by the low lift cam means.

* * * * *